US008638184B2

(12) United States Patent
Noisette et al.

(10) Patent No.: US 8,638,184 B2
(45) Date of Patent: Jan. 28, 2014

(54) ARC CHUTE FOR A CIRCUIT BREAKER, CIRCUIT BREAKER AND METHOD FOR ASSEMBLING AN ARC CHUTE

(71) Applicant: ABB Technology AG, Zürich (CH)

(72) Inventors: Philippe Noisette, Sergy (FR); Yoann Alphand, Fegersheim (FR); Marc Blanc, Lausanne (CH)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/652,834

(22) Filed: Oct. 16, 2012

(65) Prior Publication Data

US 2013/0037521 A1 Feb. 14, 2013

(30) Foreign Application Priority Data

Apr. 16, 2010 (EP) ..... 10160114

(51) Int. Cl.
*H01H 9/30* (2006.01)

(52) U.S. Cl.
USPC ..... 335/201; 218/149; 218/157

(58) Field of Classification Search
USPC ..... 335/201; 218/149, 157
See application file for complete search history.

(56) References Cited

U.S. PATENT DOCUMENTS

| | | | | |
|---|---|---|---|---|
| 3,227,846 | A * | 1/1966 | May et al. | 218/149 |
| 3,374,332 | A * | 3/1968 | Bould | 218/149 |
| 3,641,293 | A * | 2/1972 | Armitage et al. | 218/151 |
| 3,997,746 | A * | 12/1976 | Harper et al. | 218/149 |
| 6,417,474 | B1 * | 7/2002 | Rakus et al. | 218/148 |
| 7,034,242 | B1 | 4/2006 | Shea et al. | |
| 7,105,764 | B2 * | 9/2006 | Rakus et al. | 218/34 |
| 7,488,915 | B2 * | 2/2009 | Pollitt et al. | 218/149 |
| 7,598,833 | B1 * | 10/2009 | Hodges et al. | 335/201 |
| 7,705,263 | B2 * | 4/2010 | Rane et al. | 218/149 |
| 2001/0015879 | A1 | 8/2001 | Benard et al. | |
| 2005/0263492 | A1 | 12/2005 | McCoy | |

FOREIGN PATENT DOCUMENTS

| | | |
|---|---|---|
| EP | 1 655 752 A2 | 5/2006 |
| FR | 2 830 370 A1 | 4/2003 |

OTHER PUBLICATIONS

Notification Concerning Transmittal of International Preliminary Report on Patentability (Forms PCT/IB/326 and PCT/IB/373) and the Written Opinion of the International Searching Authority (Form PCT/ISA/237) dated Oct. 26, 2012, issued in corresponding International Application No. PCT/EP2011/055837. (6 pages).

(Continued)

*Primary Examiner* — Truc Nguyen
(74) *Attorney, Agent, or Firm* — Buchanan Ingersoll & Rooney PC

(57) ABSTRACT

An arc chute for a DC circuit breaker is disclosed which includes at least one stack of a plurality of substantially parallel metal plates, the at least one stack defining a first axis A in parallel to a stacking direction; an arc space adapted to allow an arc to extend along the first axis, wherein a second axis traversing in parallel to the metal plates the at least one stack and the arc space substantially orthogonal to the first axis. Further, an arc-chute housing having at least one side wall, the at least one side wall being substantially parallel to the second axis, wherein the distance between the at least one sidewall and the metal plates is, for example, less than 5 mm, such as less than 2 mm.

22 Claims, 7 Drawing Sheets

(56) References Cited

OTHER PUBLICATIONS

International Search Report (PCT/ISA/210) issued on Jul. 11, 2011, by the European Patent Office as the International Searching Authority for International Application No. PCT/EP2011/055837.

Written Opinion of The International Searching Authority (PCT/ISA/237) issued on Jul. 11, 2011, by the European Patent Office as the International Searching Authority for International Application No. PCT/EP2011/055837.

* cited by examiner

ARC CHUTE FOR A CIRCUIT BREAKER, CIRCUIT BREAKER AND METHOD FOR ASSEMBLING AN ARC CHUTE

RELATED APPLICATIONS

This application claims priority as a continuation application under 35 U.S.C. §120 to PCT/EP2011/055837, which was filed as an International Application on Apr. 13, 2011, designating the U.S., and which claims priority to European Application 10160114.4 filed in Europe on Apr. 16, 2010. The entire contents of these applications are hereby incorporated by reference in their entireties.

FIELD

The present disclosure relates to an arc chute for a direct current (DC) circuit breaker, such as for a DC circuit breaker, including at least one stack of a plurality of substantially parallel metal plates, the at least one stack defining a first axis in parallel to a stacking direction, and an arc space adapted to allow an arc to extend along the first axis, wherein a second axis traversing in parallel to the metal plates the at least one stack and the arc space substantially orthogonal to the first axis.

Further the present disclosure relates to a DC circuit breaker and to a method for assembling an arc chute.

BACKGROUND INFORMATION

Circuit breakers or air circuit breakers have been used in a DC circuit on railway vehicles. Other examples may be tramways or trolley buses. For example, such high speed DC circuit breakers may switch direct currents with more than 600 Volt and 5000 Ampere.

For example, in DC circuit breakers a lot of gas is created by disconnecting the switch contact better exhausted on all sides of the metal plates in the arc chute. For example, the gas is created by plastic frames on which the metal plates are placed. The plastic frames form dielectric layers between the metal plates. The arc chutes are then covered by a moulded housing. As the gas is exhausted on all sides, the circuit breaker needs a lot of place which cannot be used by other equipment. The place on the rolling stock can be limited.

In arc chute assemblies of known DC-circuit breakers, plastic frames and metal plates are alternatingly stacked upon each other, wherein the metal plates are disposed on the plastic frames. The plastic frames have a cut out such that an arc may be built up between two adjacent metal plates. The plastic frames are used to generate gas, such that the heat in the arc is quickly blown out of the arc chute and to increase the arc voltage by a change of the chemical composition of the air between the metal plates.

The arc can often move on the metal plates, such as within the cut out. However, the arc can stay at a corner of the cut out. Thus, the metal of the metal plates gets very hot at these corners and may start melting. In the worst cases, adjacent metal plates are connected to each other by melted metal.

This leads to a short lifetime of the arc chutes and a big structural dimension due to an increased distance between the metal plates to avoid a connection between two adjacent metal plates due to melted metal, and an increased number of the metal plates and plastic frames.

Known arc chutes can be heavy and have a high height. Further, the wear is important, such as at high currents, for example at currents greater than 1 kA. The wear can depend on the number of operations, the current density and the arcing time (time constant). Thus, the wear of the arc chute is not predictable. Hence, maintenance operation is difficult to plan but is nevertheless indispensable. For example, the metal or steel plates may be often checked and replaced. Further, the plastic frames may be checked as well and sometimes even replaced. Further, there is a risk of steel drop minimum between the plates, such that less voltage is built up. In some cases, the circuit breaker may not be able to be cut the next time. Further, more than 120 components can be assembled and the clearance distance may increase.

US 2001/0015879 A1 discloses a circuit breaker with two arc chute stacks parallel to each other and an inner and an outer housing in which the functional components of the breaker are located. A sidewall of the housing which is aligned in parallel to the two arc chute stacks having openings.

US2005/0263492 A1 discloses a low voltage circuit breaker for continuous current rating up to 400 amps having a pivoting member with a handle and an arc chute stack to extinguish electric arcs.

SUMMARY

An arc chute is disclosed for a traction vehicle DC circuit breaker or for a substation DC circuit breaker working at medium voltages between 600V and 3600V. The arc chute includes: at least two stacks of a plurality of substantially parallel metal plates, at least one of the two stacks defining a first axis in parallel to a stacking direction; an arc space adapted for extending an arc along the first axis, wherein a second axis traversing in parallel to the at least two parallel stacks and the arc space, substantially orthogonal to the first axis; an arc-chute housing having at least one side wall, the at least one side wall being substantially parallel to the second axis; and a housing of the arc chute having openings in a direction of the second axis for exhausting gas, wherein a distance between the at least one sidewall and the metal plates is less than 5 mm.

A method is disclosed for assembling an arc chute of a traction vehicle DC circuit breaker or substation DC circuit breaker working at medium voltages between 600V and 3600V. The method includes: stacking a plurality of substantially parallel metal plates parallel to a first axis, wherein the arc space is adapted to allow an arc to extend along the first axis and wherein a second axis traverses in parallel to the metal plates and the arc space, substantially orthogonal to the first axis; mounting at least one side wall of a housing of the arc chute substantially parallel to the second axis, wherein a distance between sidewalls and the metal plates is less than 5 mm; and inserting a plurality of substantially parallel deflectors in respective grooves in at least one sidewall.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
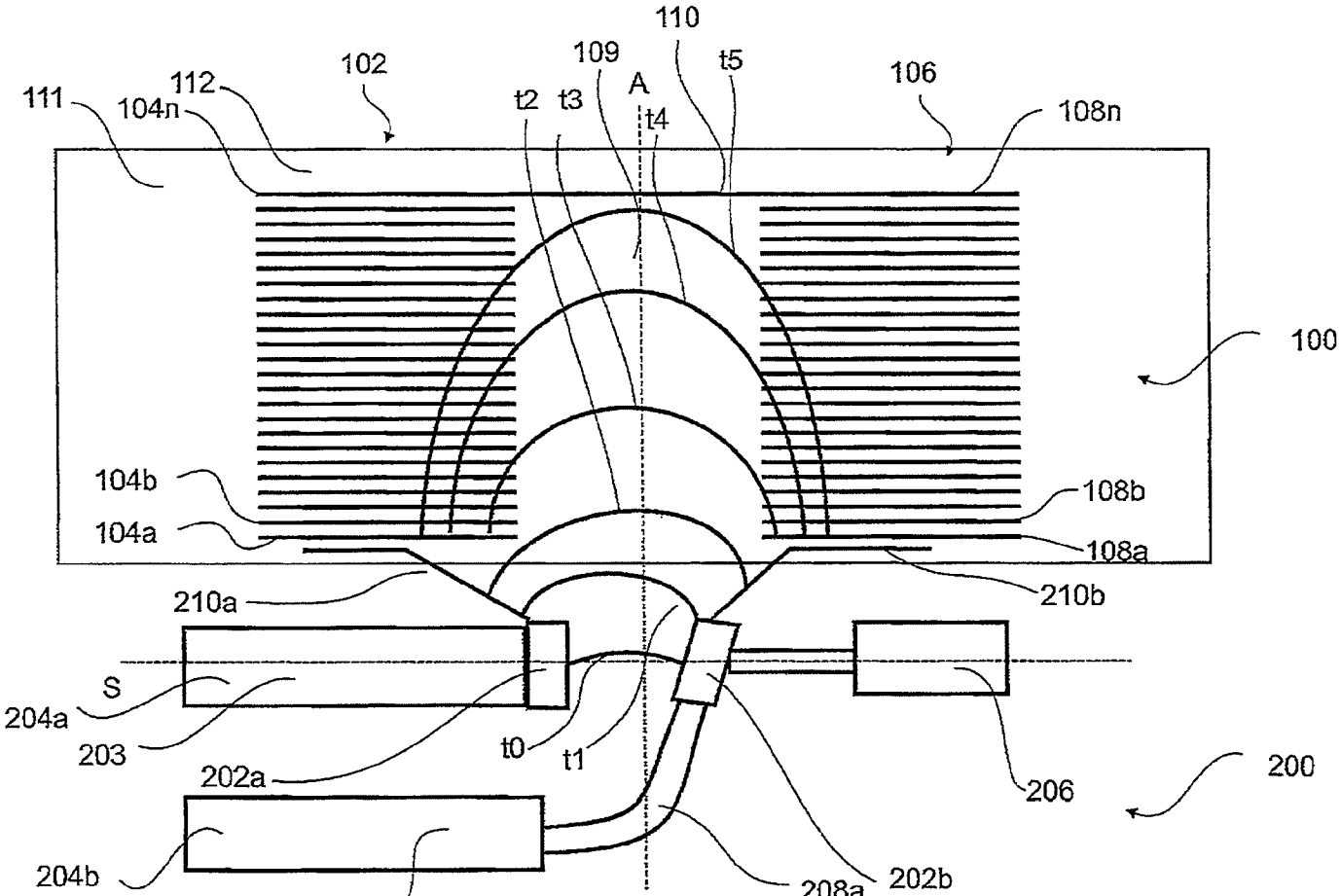
FIG. 1 shows schematically a side view of an exemplary embodiment of a circuit breaker with open switch contacts.

An arc chute, a circuit breaker and a method for assembling an arc chute are disclosed which can address inconveniences of known arc chutes, such as an arc chute which involves less installation space and can be easier to adapt to specification and currents.

According to an exemplary embodiment, an arc chute for a direct current (DC) circuit breaker is provided, including at least one stack of a plurality of substantially parallel metal plates, the at least one stack defining a first axis in parallel to a stacking direction; an arc space adapted to allow an arc to extend along the first axis, wherein a second axis traversing in parallel to the metal plates the at least one stack and the arc space substantially orthogonal to the first axis; and an arc-chute housing having at least one side wall, the at least one side wall being substantially parallel to the second axis, wherein the distance between the at least one sidewall and the metal plates is less than 5 mm, such as less than 2 mm.

In an exemplary embodiment, the circuit breaker is an air DC circuit breaker. Thus, each current interruption generates an arc. An arc can start from a contact separation and remains until the current is zero. In exemplary embodiments, to be able to cut out DC currents high speed DC circuit breakers build up DC voltages that are higher than the net voltage. To build up a DC voltage, air circuit breakers may use an arc chute or extinguish chamber in which metallic plates are used to split arcs into several partial arcs, the arc is lengthened and gases are used to increase the arc voltage by a chemical effect, for example, by evaporation of plastic or another material.

A circuit breaker using such an arc chute according to an exemplary embodiment is less space consuming. This may be important for application where the space is limited, for example on trains.

In an exemplary embodiment, which may be combined with other embodiments disclosed herein, the at least one side wall contacts the metal plates.

For example, the arc chute housing has two side walls.

In an exemplary embodiment, the at least one side wall has a dimension in direction of the second axis, such that the side wall covers completely at least the at least one stack and the arc space. For example in case of two stacks, the side wall covers the two stacks and the arc space between the two stacks. In an exemplary embodiment, the at least one side wall has a dimension in direction of the second axis corresponding at least 110%, such as at least 120% of the dimension of the at least one stack, such as of the two stacks, and the arc space in direction of the second direction.

The side wall can have a height in direction of the stacking direction corresponding at least to the dimension of the stack in direction of the first axis.

In an exemplary embodiment, which may be combined with other embodiments disclosed herein, the side wall is substantially closed.

In an exemplary embodiment, which may be combined with other embodiments disclosed herein, at least two parallel stacks of metal plates, wherein a second axis traverses the at least two parallel stacks.

For example, in an exemplary embodiment, the metal plates are substantially rectangular and have, for example, respectively a substantially V-shaped cut-out directed to the arc space, wherein the second axis is substantially parallel to two side edges of the metal plates adjacent to the sidewalls.

In an exemplary embodiment, which may be combined with other embodiments disclosed herein, the housing of the arc chute has openings in direction of the second axis.

In an exemplary embodiment, which may be combined with other embodiments disclosed herein, the opening has a dimension in direction of the first axis of at least 90%, such as 95%, of the at least one stack.

In an exemplary embodiment, the opening has a dimension corresponding substantially to the dimension of the metal plates in a direction orthogonal to the first axis and the second axis, for example, at least 90%, for example, at least 95% of the width of the metal plates. The width of the metal plates can be measured along a third axis orthogonal to the first axis and orthogonal to the second axis.

In an exemplary embodiment, the metal plates are substantially rectangular, include a first edge in the direction of the arc space, and a second edge opposite to the first edge, and may also include two side edges substantially parallel to the second axis, wherein the opening of the arc chute housing is adjacent to and/or on the side of the second edge of the metal plates.

For example, more than 70%, such as more than 90%, of a surface of a metal plate of the at least one stack faces the surface of an adjacent metal plate in the same stack.

In an exemplary embodiment, which may be combined with other embodiments disclosed herein, the metal plates of the arc chute may have a surface of about 3000 $mm^2$ to about 12000 $mm^2$, such as between about 5000 $mm^2$ and about 8000 $mm^2$ and/or have an ratio between extension in the longitudinal direction, parallel to the second axis, and the extension in a transversal direction of about 1 to 2, for example, 1.1 to 1.5.

For example in an embodiment, the at least one stack includes a group of metal plates, wherein the metal plates of the group of metal plates are supported by at least one support device adapted to maintain the metal plates in a parallel relationship to another and adapted to insert and remove the group of metal plates together.

In an exemplary embodiment, which may be combined with other embodiments disclosed herein, each metal plate of the group of metal plates includes a plurality of cut-outs for inserting the support device, wherein the metal plates and the support device are adapted to each other, such that when the support device is inserted in the respective cut-outs of the metal plates a rearward edge of the support device opposite to the metal plate lies substantially at the or a greater distance to the sidewall than the metal plate, for example, the side edge parallel to the second axis of the metal plate, into which the support device is inserted.

For example, in an embodiment, the metal plates, such as the metal plates of the group of metal plates, respectively have a distance between each other of about 2 mm to about 4 mm.

According to a further exemplary embodiment, a circuit breaker is provided, including a switch unit having a first switch contact and a second switch contact, wherein the second switch contact is movable between a first position, the first switch contact contacts the second switch contact and a second position in which the first and second switch contacts are separated from each other; and an arc chute according an embodiment disclosed herein.

In an exemplary embodiment, which may be combined with other embodiments disclosed herein, the circuit breaker is an air circuit breaker.

For example, in an embodiment, the circuit breaker is circuit breaker for a traction vehicle, in particular a railway vehicle, a tramway, a trolleybus, and a substation providing energy for rolling stocks or the like.

In an exemplary embodiment, which may be combined with other embodiments disclosed herein, the second switch contact is movable substantially along a moving direction, wherein the second axis is substantially parallel to the moving direction.

In an exemplary embodiment, the switch unit includes: a first switch contact; a second switch contact movable between first position, wherein the first switch contact contacts the second switch contact, and a second position, wherein the second switch contact is separated from the first switch contact; a positioning device to position an arc chute on the switch unit, wherein the arc chute includes a plurality of substantially parallel metal plates, the positioning element being arranged such that an arc, which is created between the first switch contact and the second switch contact is guided into the arc chute in an arc displacement direction in order to be extinguished; and at least one gas emitting element including a gas emitting layer having a layer surface facing the first switch contact and the second switch contact, wherein the gas emitting element is arranged at a distance to the first switch contact and the second switch contact, such that at an interruption operation of the circuit breaker at its nominal current an arc between the first switch contact and the second switch contact vaporizes a portion of the gas emitting layer.

With a gas emitting plate, back arc re-ignition can be delayed. For example the overpressure helps to push the arc into the arc chute. Thus, the breaker capability is increased.

In an exemplary embodiment, the circuit breaker may switch direct currents with more than 600 Ampere.

In an exemplary embodiment, the arc created between the first switch contact and the second switch contact creates so much heat, such that the portion of the gas emitting layer is vaporized.

In an exemplary embodiment, the gas emitting layer is formed by a material that increases, in a vaporized state the dielectrically resistance between the first switch contact and the second switch contact.

In an exemplary embodiment, the positioning device is a screw, a hinge, a bolt, a stop, a bar, and the like. For example, the positioning device is used to connect the arc chute to the switching unit.

For example, in an embodiment, the second switch contact is movable substantially along a moving direction, wherein the layer surface is arranged substantially parallel to the plane defined by the moving direction and the arc displacement direction.

In an exemplary embodiment, which may be combined with other embodiments disclosed herein, the at least one gas emitting element is disposed such that the vaporized gas emitting layer pushes the arc into the arc chute and/or increases the dielectric resistance between the first switch contact and the second switch contact.

For example, in an embodiment, the switch unit includes at least two gas emitting elements having a layer surface facing the first switch contact and the second switch contact, wherein layer surfaces of the at least two plates are facing each other.

In an exemplary embodiment, the layer surfaces of the at least two plates are disposed substantially in parallel.

In an exemplary embodiment, which may be combined with other embodiments disclosed herein, the distance of the layer surfaces to the first switch contact and/or the second switch contact, such as in the first position and the second position of the second switch contact, is between about 15 mm and about 40 mm, for example between about 25 mm and about 30 mm.

For example, in an embodiment, the gas emitting layer is manufactured from Polytetrafluoroethylene (PTFE), wherein in particular the gas emitting layer has a thickness of about 2 to about 8 mm, for example of about 3 mm to about 5 mm. In another embodiment the gas emitting layer is manufactured from other types of a Fluoropolymers for example form Fluorinated ethylene-propylene (FEP), Perfluoroalkoxy (PFA), Polychlorotrifluoroethylene (PCTFE), Polyvinylidene fluoride (PVDF) or Polyvinylidene fluoride (PVF). In another embodiment the gas emitting layer is manufactured from types of Fluoroelastomers as Copolymers or Terpolymers. In another exemplary embodiment the gas emitting elements are not massive pieces of material rather have a surface coating of a type of Fluoropolymers as PTFE or of a type of Fluoroelastomers as Copolymer which evaporate the gas.

In an exemplary embodiment, which may be combined with other embodiments disclosed herein, the switch unit may further include a first horn electrically connected to the first switch contact, wherein the first horn is disposed to guide a first foot of an electric arc to the arc chute, in particular to a first stack of the arc chute, and/or a second horn electrically connected to the second switch contact, wherein the second horn is disposed to guide a second foot of the electric arc to the arc chute, such as to a second stack of the arc chute, wherein the layer surface has a size such that at least a portion of the first horn and/or the second horn in the direction of a moving direction of the second switch contact is disposed in parallel to the layer surface, wherein in particular the portion is greater than 25% of the horn, for example, greater than about 50% of the extension of the horn in the direction of the moving direction.

For example, in an embodiment, the at least one gas emitting element is plate shaped, and for example a substantially T-shaped plate, having a base portion and two arms, wherein the switch unit includes a switching space, in which the first switch contact and the second switch contact in the first position and in the second position are permanently disposed, wherein the base portion of the at least one gas emitting element is disposed in the switching space, and in particular the arms extend in parallel to the first and/or second horn.

In an exemplary embodiment, which may be combined with other embodiments disclosed herein, the at least one gas emitting layer extends in arc displacement direction substantially to the plane of the closest metal plate for splitting the arc in the arc chute. The closest metal plate can be the most proximal metal plate of the arc chute towards the switch unit.

In an exemplary embodiment, which may be combined with other embodiments disclosed herein, the circuit breaker is a DC circuit breaker for a traction vehicle, in particular a railway vehicle, a tramway, a trolleybus and the like.

According to an exemplary embodiment, a method for assembling an arc chute of a circuit breaker is provided, where the arc chute includes an arc space. The method includes: stacking a of a plurality of substantially parallel metal plates parallel to a first axis, wherein the arc space is adapted to allow an arc to extend along the first axis; wherein a second axis traversing in parallel to the metal plates the at least one stack and the arc space substantially orthogonal to the first axis; and mounting at least one side wall of a housing of the arc chute substantially parallel to the second axis, wherein the distance between the sidewalls and the metal plates is less than 5 mm, in particular less than 1 mm. In another embodiment, the stack of metal plates contacts with the side walls.

In an exemplary embodiment, which may be combined with other embodiments disclosed herein, the method further includes mounting the arc chute on a switching unit.

Reference will now be made in detail to the various embodiments, one or more examples of which are illustrated in the figures. Each example is provided by way of explanation, and is not meant as a limitation of the disclosure. Within the following description of the drawings, the same reference numbers refer to the same components. Generally, only the differences with respect to individual embodiments are described.

FIG. 1 shows a side view of a high voltage direct current (DC) circuit breaker working at medium voltages, for example, between 600V and 3600V. The circuit breaker is, for example, an air circuit breaker. The circuit breaker includes an arc chute 100 and a switch unit 200. The arc chute includes a first stack 102 of metal plates 104*a*, 104*b*, . . . , 104*n* and in an embodiment, which may be combined with other embodiments disclosed herein, a second stack 106 of metal plates 108*a*, 108*b*, . . . , 108*n*.

In an exemplary embodiment, the metal plates 104*a*, 104*b*, . . . , 104*n*, 108*a*, 108*b*, . . . , 108*n* of the first and the second stack 102, 106 are substantially equal. An arc space 109 is disposed between the first stack 102 and the second stack 106 of metal plates. When the circuit breaker is opened, an arc can mount in the arc space 109.

The arc chute can be symmetric to an axis traversing the arc space 109 which is parallel to the stacking direction of first stack 102 of metal plates and the second stack 106 of metal plates. Further, the top level metal plate 104*n* of the first stack 102 can be electrically connected to the top level metal plate 108*n* of the second stack 106 with a connection bar 110. Thus, the top level metal plate 104*n* of the first stack is on the same electrical potential as the top level metal plate 108*n* of the second stack 106.

The lowest metal plate or level zero metal plate 104*a* of the first stack 102 and the lowest metal plate or level zero metal plate 108*a* can be the closest metal plates of the respective stacks 102, 106 with respect to the switch unit 200. Hence, the lowest metal plates 104*a*, 108*a* and the top level plates 104*n*, 108*n* are disposed on opposite ends in stacking direction of the respective stack 102, 106 of metal plates.

In an exemplary embodiment, each stack 102, 106 includes about 36 metal plates 104*a*, 104*b*, . . . 104*n*, 108*a*, 108*b*, . . . 108*n*. Other embodiments may even include more than 36 metal plates. The number of metal plates can, for example, depend on the nominal net voltage that is switched by the circuit breaker.

In an exemplary embodiment, the arc chute 100 is disposed in a casing having at least one side wall 112. In an exemplary embodiment, the arc chute 100 with its casing may be easily separated from the switch unit 200. Thus, the maintenance time may be reduced.

The switch unit 200 includes a first switch contact 202*a*, which may be electrically connected to an electric network or a load by a first switch contact terminal 204*a*. The first switch contact can be connected with a first switch contact bar or bus bar 203 to the first switch contact terminal 204*a*, wherein the first switch contact bar 203 includes the first switch contact terminal 204*a*. The first switch contact 202*a* can be fixed to a first end of the first switch contact bar 203, and the first switch contact terminal 204 is disposed at a second end of the first switch contact bar 203, opposite to the first end.

Further, the switch unit 200 includes a second switch contact 202*b*. The second switch unit is moved by a driving unit 206 in a moving direction S, to move the second switch contact 202*b* from a first position in which the first switch contact 202*a* is in physical contact with the second switch contact 202*b*, and a second position in which the first switch contact 202*a* is separated from the second switch contact 202*b*. The second position is shown in FIG. 1. The second switch contact 202*b* may be connected via a second switch contact terminal 204*b* to an electrical network or the load. The second switch contact 202*b* is electrically connected to the second switch contact terminal 204*b* by a flexible conductor 208*a* and a second switch contact bar 208*b*, wherein the flexible conductor 208*a* is connected to a first end of the second switch contact bar 208*b*. The second switch contact terminal 204*b* can be disposed at a second end of the second switch contact bar 208*b*, wherein the second end is opposite to the first end of the second switch contact bar 208*b*.

The arc space 109 can be disposed above the first and second switch contact in operation of the circuit breaker, when the circuit breaker is in closed position (e.g., the first switch contact 202*a* contacts the second switch contact 202*b*). Further, the stacking direction of the stack of metal plates 102, 106 is substantially parallel to an arc displacement direction A, which is substantially orthogonal to the moving direction S. For example, the stacking direction or arc displacement direction A corresponds to a direction in which the arc extends into the arc chute. For example, the metal plates 104*a*, 104*b*, . . . , 104*n*, 108*a*, 108*b*, . . . , 108*n* and the connection bar 110 are substantially parallel to the moving direction S.

A first horn 210*a* is fixed to the first contact 202*a* to guide a foot of an arc to the metal plates 104*a*, 104*b*, . . . 104*n*, such as to the lowest metal plate 104*a*, of the first stack 102 of the arc chute 100. Further, the switch unit 200 is provided with the second horn 210*b* which is disposed, such that the arc having foot at the second switch contact 202*b* jumps to the horn 210*b* and moves to the metal plates 108*a*, 108*b*, . . . , 108*n*, such as to the lowest metal plate 108*a*, of the second stack 106.

In an exemplary embodiment, the lowest metal plate 104*a* of the first stack 102 and the lowest metal plate 108*a* of the second stack 106 are respectively electrically connected to the first switch contact 202*a* and the second switch contact 202*b*. Thus, an arc foot of an arc created by interrupting a current does not remain on the first and second horns 210*a*, 210*b* and jump on the lowest metal plates 104*a*, 108*a*. Once, the respective arc foot has jumped to the lowest metal plates, current flows through a respective equipotential connection. The horns need not be heated up by the arcs and thus need not evaporate. Further, the horn wear out is reduced such that the horns, for example the first horn 210*a*, and a second horn 210*b* may withstand the life time of the circuit breaker. The heat dissipation can be increased once the arc has jumped onto the lowest metal plates. Further, less gas is generated close to the switch contacts. A heat concentration close to the switch contacts can be reduced, such that the risk of a plasma generation and recognition phenomenal is reduced.

FIG. 1 shows a side view of the circuit breaker in the open state, wherein the first switch contact 202*a* is separated from the second switch contact 202*b*. Further, FIG. 1 shows schematically an arc expansion within the arc chute 200, in particular, the arcs at different moments after the opening of the switch by moving the second switch contact 202*b* away from the first switch contact 202*a*.

At a first time, t0, after the contact separation of the first switch contact 202*a* and the second switch contact 202*b* the arcing starts.

Then, at t1, the arc, or one foot of the arc, leaves one of the first or second switch contacts 202*a*, 202*b*, and jumps to the horn 210*a*, 210*b* of the respective switch contact 202*a*, 202*b*. This may either happen first on the fixed, for example, the first switch contact 202*a*, or on the moving contact, for example, the second switch contact 202*b*. At t2, the arc leaves the second switch contact. Then, the arc feet are located on first horn 210*a* and the second horn 210*b* respectively.

Then, at t3, the arc feet jump on the respective level zero or lowest metal plates 104*a*, 108*a* and the arc continues to climb within the arc chute. At this stage, several little arcs can be generated between respective adjacent metal plates of the first and second stack 102, 104.

At t4 the arc is well established on the lowest metal plates 104*a*, 108*a* of the first and second stack 102, 106 respectively and continues to climb within the arc chute, in particular the arc space 109. At t5 the arc is fully elongated having reached the top of the arc chute, so that the maximum voltage is built. The voltage built up by the arc starts at t0, increases from t1 to t4, and reaches its maximum value approximately at t5. The sequence is, for example, influenced by the magnetic field generated by the current, for example for currents greater than 100 A, a chimney effect due to hot gases, for example for currents lower than 100 A, and/or the mechanical behaviour of the circuit breaker, for example the velocity of the second switch contact 202*b*.

In an exemplary embodiment, the arc remains present until the current is zero, then the arc is naturally extinguished. The arcing time can be proportional to the prospective short circuit current in time constant of the circuit, the current level when opening, the required voltage to be built up for cutting the contact velocity, for example of the second switch contact, the geometrical circuit breaker design, for example the chimney effect, and/or the material used which has influence on the gas created in the arc chute or the circuit breaker.

Figure 2:
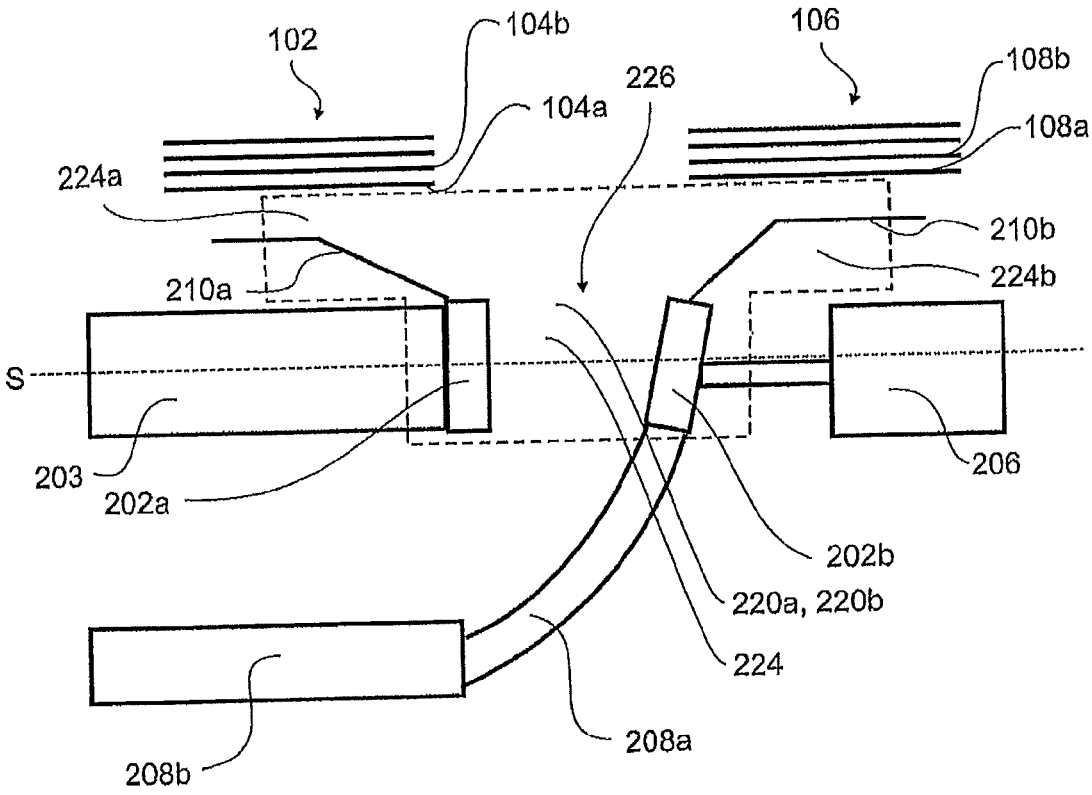
FIG. 2 shows schematically a side view of a portion of an exemplary switch unit.
Figure 3:
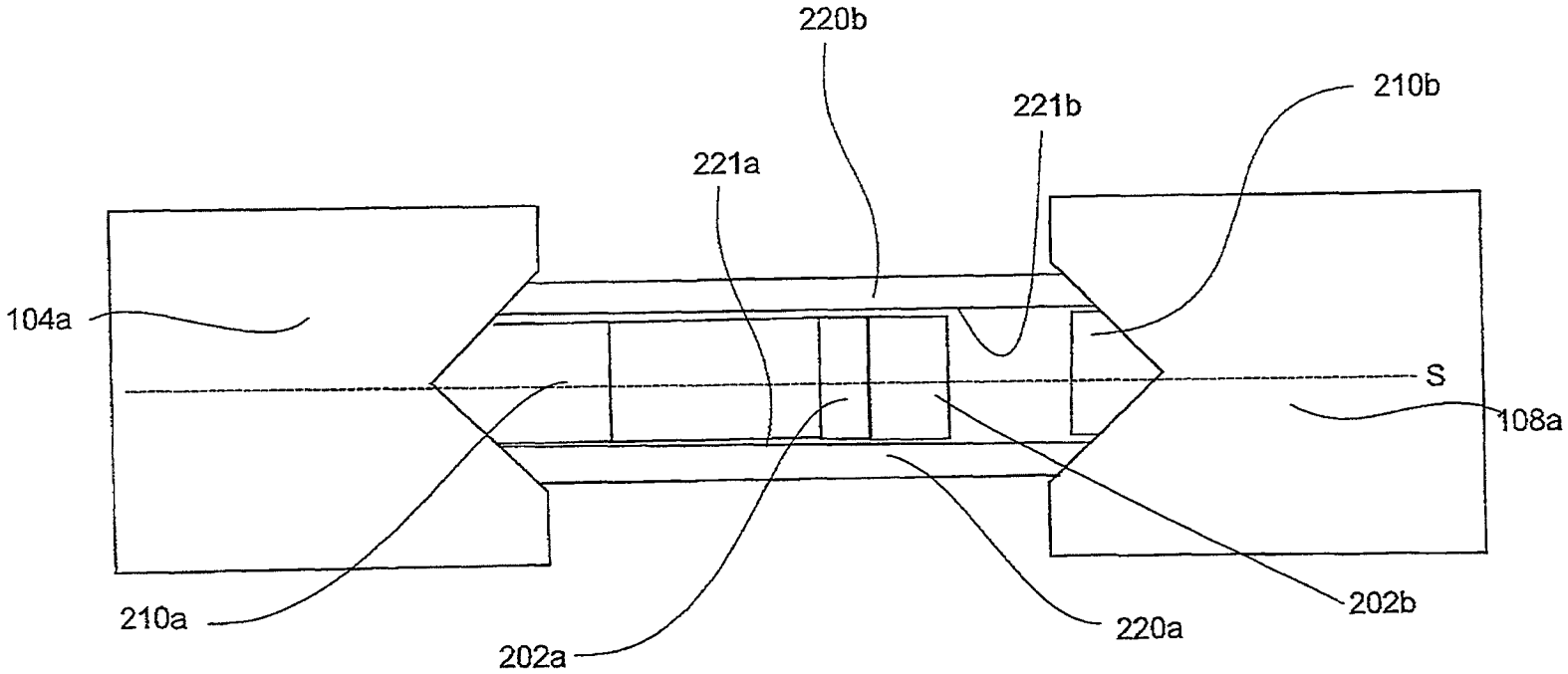
FIG. 3 shows schematically a section of the exemplary circuit breaker in a top view.

FIG. 2 shows schematically a perspective view of a portion of the switch unit 200, and FIG. 3 shows a top view of the switch unit 200 and respective lowest metal plates 104*a*, 108*a* of the first stack 102 and a second stack 106 of the arc chute 100. In the switch units 200, a first polytetrafluoroethylene (PTFE) plate 220*a* and a second PTFE plate 220*b* are disposed in parallel to the moving direction or switching axis S of the second switch contact 202*b* and/or in parallel to the stacking direction or arc displacement direction A. Also, another material may be used instead or in addition to PTFE, however the material may generate or evaporate a gas to alter the atmosphere in the circuit breaker to reduce back arc re-ignition and/or increase the dielectric resistance, for example, in the arc chute and/or the switching space 226 of the switch unit 200.

In an exemplary embodiment, the PTFE plates are substantially T-shaped. However, plates with another shape may also be provided, for example, V-shaped or rectangular shaped PTFE-plates.

In an exemplary embodiment, which may be combined with other embodiments disclosed herein, the first PTFE plate 220*a* and a second PTFE plate 220*b* are disposed, such that a substantial portion in the direction of the moving direction S, such as at least 25%, of the first horn 210*a* and the second horn 210*b* are respectively disposed between them. In case the PTFE plates 220*a*, 220*b* are T-shaped, they can include a base 224 and two arms 224*a*, 224*b*, wherein the arms 224*a*, 224*b* extend from a switching space 226 in which the first switch contact 202*a* and the second switch contact 202*b* are permanently disposed in open and closed state of the circuit breaker, e.g. when the second switch contact is in the first position and in the second position, between a frame of the switch unit 200, for example, supporting the arms 224*a*, 224*b* and thus the PTFE plates 220*a*, 220*b*, and the respective lowest metal plate 104*a*, 108*a* of the first and second stack 102, 106. For example, in case the arc chute is removed from the switch unit 200, the PTFE plates may be easily removed in direction of the arc chute and replaced.

In an exemplary embodiment, which may be combined with other embodiments disclosed herein, the first switch contact 202*a* and/or the second switch contact 202*b* is disposed closely between the two PTFE plates 220*a*, 220*b* in an open state and a closed state of the circuit breaker. For example, the PTFE plates form, a limit for the created arcs in switching space 226 in a direction orthogonal the stacking direction or arc displacement direction A and the switching axis or moving direction S.

In an exemplary embodiment, the PTFE plates, such as the base 224 and the arms 224*a*, 224*b* of the PTFE plates, extend in the direction of the arc chute substantially to a plane of the lowest metal plates 104*a*, 108*a* of the first stack 102 and a second stack 106, in particular just below the lowest metal plates 104*a*, 108*a*. Thus, during operation, (e.g., when the arc chute 100 is mounted on the switch unit 200), the PTFE plates 220*a*, 220*b* do not move in the direction of the stacking direction A. Further, in an embodiment, the PTFE plates 220*a*, 220*b* are arranged, such that they may not move in the direction of the moving direction S.

In case of an opening of the switch contact, when the arc between the first switch contact 202*a* and a second switch contact 202*b* is created, the PTFE plates 220*a*, 220*b* guide the arc between them. Due to the hot temperature of the arc, some gas can be evaporated from the surface of the PTFE guides, such that the gas pushes the arc out of the region between the first switch contact 202*a* and the second switch contact 202*b*. The arc can be faster guided into the arc chute 100. Further, the gas is used to change the composition of the atmosphere in the arc chute, such as to increase the resistance between adjacent metal plates 104*a*, 104*b*, . . . , 104*n*, 108*a*, 108*b*, 108*n*.

With the PTFE plates 220*a*, 220*b* or PTFE gates, back arc re-ignition is delayed, because the PTFE evaporates very quickly and generates an overpressure. Thus, the overpressure help to push the arc into the arc chute. Further, thanks to the PTFE, chemical gas composition is modified in the region between the first switch contact 202*a*, and the second switch contact 202*b* and the generation of plasma is delayed. Thus, back arc re-ignition between the contacts may still happen but at much higher currents than without the PTFE plates 220*a*, 220*b*. Thus, the breaker breaking capability is increased.

Figure 4:
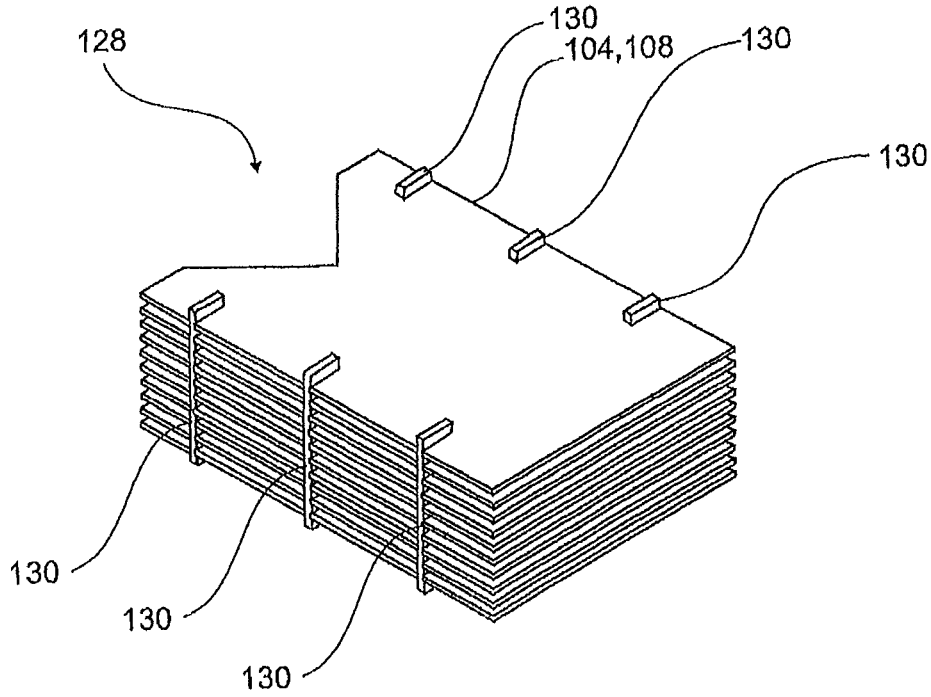
FIG. 4 shows schematically a group of exemplary metal plates.

FIG. 4 shows a group 128 of metal plates 104, 108 for the first stack 102 or for the second stack 106. In an exemplary embodiment, which may be combined with other embodiments disclosed herein, the group of metal plates 128 being connected or grouped by a plurality of comb like support devices 130. For example, the group of metal plates 128 for the arc chute may include five to twenty metal plates, such as ten metal plates.

Figure 5:
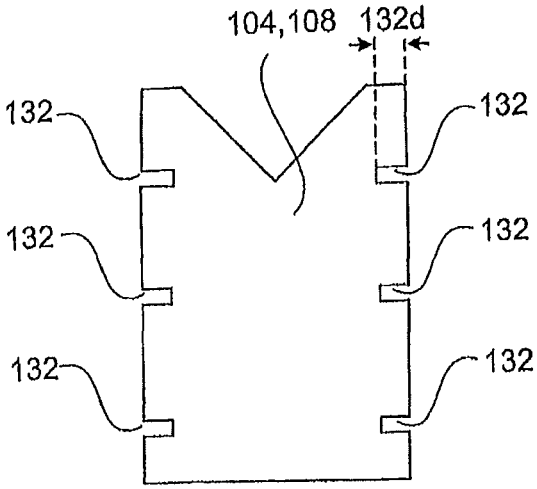
FIG. 5 shows schematically an exemplary metal plate of a stack.

A schematical top view of an exemplary embodiment of a single metal plate 104, 106 is shown in FIG. 5. Each metal plate 104, 106 include a plurality of cut outs 132 for the support device 130, for example six cut outs as shown in FIG. 5. The cut outs 132 can have a depth 132*d*. Also another number of cut outs may be provided in the metal plates, for example, four cut outs. The cut outs 132 are adapted for the comb like support device 130. In an exemplary embodiment, the cut outs 132 are substantially rectangular, so that the support device may be slidingly introduced into the cut-outs 132.

The metal plates can have a thickness of about 0.5 mm to about 2 mm, such as between 0.5 and about 1.5 mm, for example about 1 mm. In an exemplary embodiment, which may be combined with other embodiments disclosed herein, the metal plates 104, 108 may have a surface of about 3000 $mm^2$ to 12000 $mm^2$, such as between about 5000 $mm^2$ and about 8000 $mm^2$. In an exemplary embodiment, the volume of the metal plates is between about 3000 $mm^3$ and about 20000 $mm^3$, such as between about 5000 $mm^3$ and about 10000 $mm^3$. For example a single metal plate or steel plate may have a weight between 30 and 100 g, for example, about 50 g.

In an exemplary embodiment, the metal plates are substantially rectangular having a V-shaped cut-out at one of the four edges, for example, to be disposed adjacent to the arc space 109. The cut out can correspond to more than 50 percent of the edge having the cut-out.

In an exemplary embodiment, which may be combined with other embodiments disclosed herein, the distance between the metal plates is about 2 to about 4 mm, such as 2.5 mm.

Figure 6:
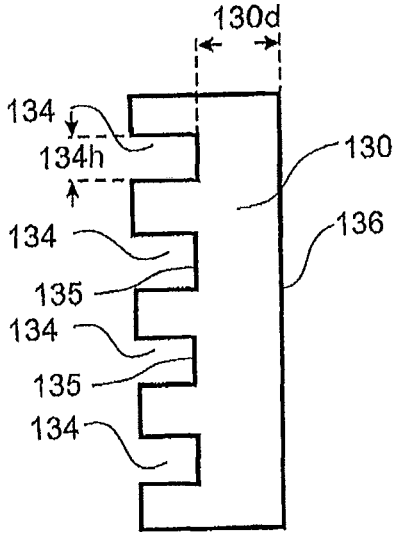
FIG. 6 shows schematically a side view of an exemplary support device.

FIG. 6 shows a schematical side view of an exemplary embodiment of a support device 130. The comb like support device 130 has a plurality of support cut outs 134, for example, regularly spaced. The support cut outs 134 are provided on a side first to be introduced in the cut outs 132 of the metal plates 104, 108. In an exemplary embodiment, the support cut outs 134 may have height 134*h* corresponding to the thickness of the metal plates 104, 108. Thus, with a plurality of comb like support devices 130, a plurality of the metal plates 104, 108 may be grouped. For example, the support device may be fabricated from a plastic material.

Further, in an embodiment, which may be combined with other embodiments disclosed herein, the remaining thickness 130*d* of the support device between a bottom 135 of the support cut outs 134 and a rearward edge 136 of the support device 130 opposite to the support cut outs 134 corresponds substantially to the depth 132 of the cut out in the metal plates. Thus, when the comb like support device 130 is inserted in the cut outs 132 of the metal plates, the rearward edge 136 opposite to the support cut outs 134 is not projecting from the circumference of the metal plates 104, 108. Hence, a sidewall of the housing may contact the metal plates of the arc chute.

For example, more than 70%, such as more than 90%, of a surface of a metal plate of a stack face the surface of an adjacent metal plate. That means that the space between adjacent metal plates is substantially free, for example, from a plastic frame or other material that may impede a creation of an arc between the respective adjacent metal plates. In an exemplary embodiment, which may be combined with other embodiments disclosed herein, more than 95% of the surface of a metal plate of the stack faces the surface of an adjacent metal plate. For example, the arc between adjacent metal plates of a stack 102, 106 may not stay at the same place on the surface of a metal plate. They may use the complete space to move around on the surface of the metal plate of an arc chute. Thus, the wear of the metal plates is more uniform, such that the distance and the thickness of the plates may be reduced. Further, also the cooling of the metal plates is improved.

Figure 7:
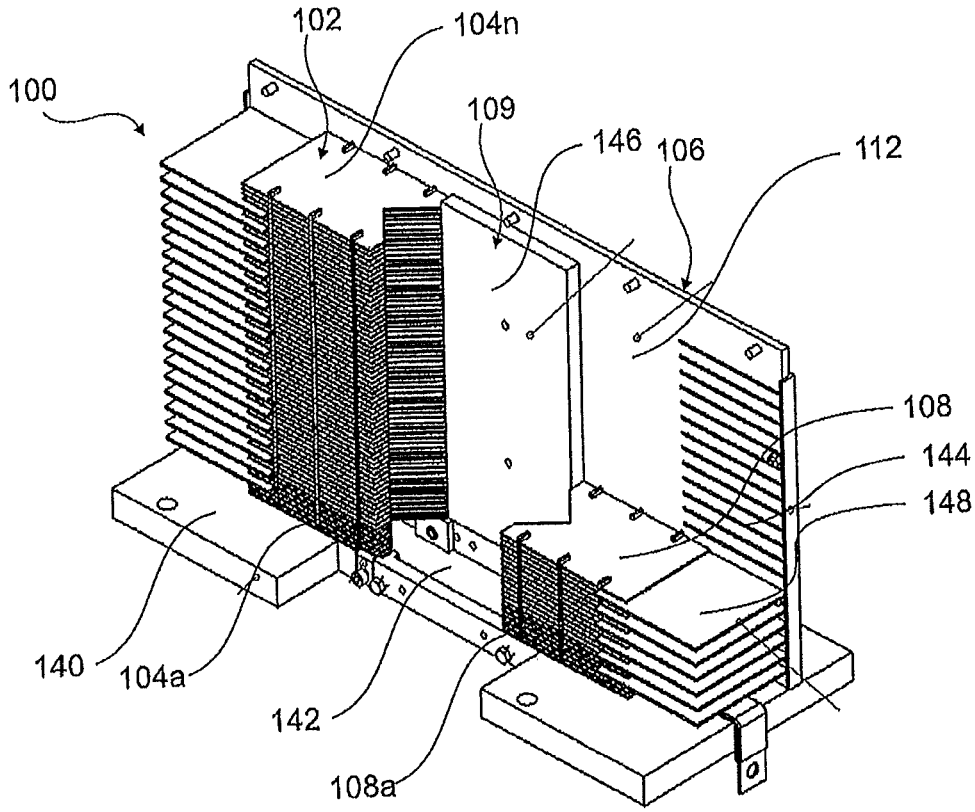
FIG. 7 shows schematically a perspective view of an exemplary arc chute according to an embodiment.
Figure 8:
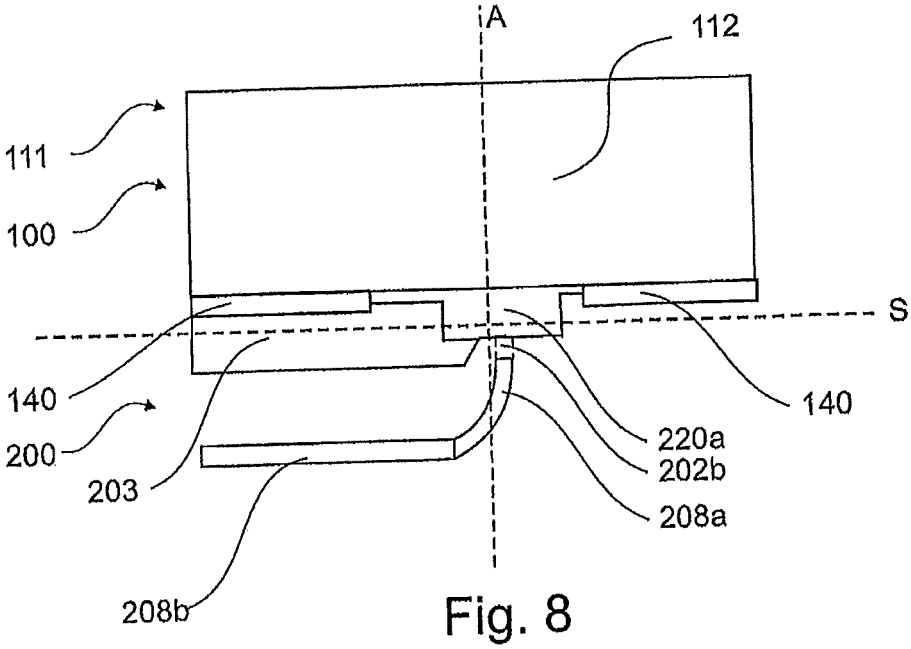
FIG. 8 shows schematically a side view of some elements of an exemplary embodiment of a circuit breaker.

FIG. 7 shows schematically a perspective view of an arc chute according to an embodiment and FIG. 8 shows schematically a side view of an embodiment circuit breaker. The arc chute 100 has an arc chute base 140, which is mounted on the switch unit 200. The base 140 has an opening 142 for the horns of the switch unit 200. Thus, the opening 142 can be disposed over the first switch contact 202*a* and a second switch contact 202*b*. The opening can connect the arc chute 100, such as the arc space 109 of the arc chute 100, with the switching space 226. An arc created between the first switch contact 202*a* and the second switch contact 202*b* enters the arc chute 100 through the opening 142. Further, the arc chute 100 includes a housing 111 having sidewalls 112. In an exemplary embodiment, the sidewalls 112 are manufactured from a plastic plate. For example, the sidewalls are substantially closed. The side wall 112 may be disposed in a plane parallel to a plane spanned by the moving direction S and the stacking direction A. In an embodiment, an internal stopper wall 146 is fixed to the sidewall 112 in the arc space 109, such as to each sidewall 112, to limit the movement of the metal plates 104, 108 in the direction of the arc space 109 over the base opening 142, so that an arc can ascent within the arc chute 100 between the first stack 102 and the second stack 106. In a further embodiment, the stopper plate may be replaced by two parallel rails fixed to the side wall 112. In an exemplary embodiment, the blocks 128 of metal plates are inserted from the top into the arc chute 100.

In an exemplary embodiment, which may be combined with other embodiments disclosed herein, the arc chute may include a plurality of substantially parallel deflectors 148 which are inserted in respective grooves 144 in the sidewalls 112. The grooves 144 can be substantially parallel to the plates 104*a*, 104*b*, . . . 104*n*, 108*a*, 108*b*, . . . 108*n*. For example, the deflector plates 148 guides the gas created in the arc chute in parallel to the metal plates out of the arc chute.

Figure 9:
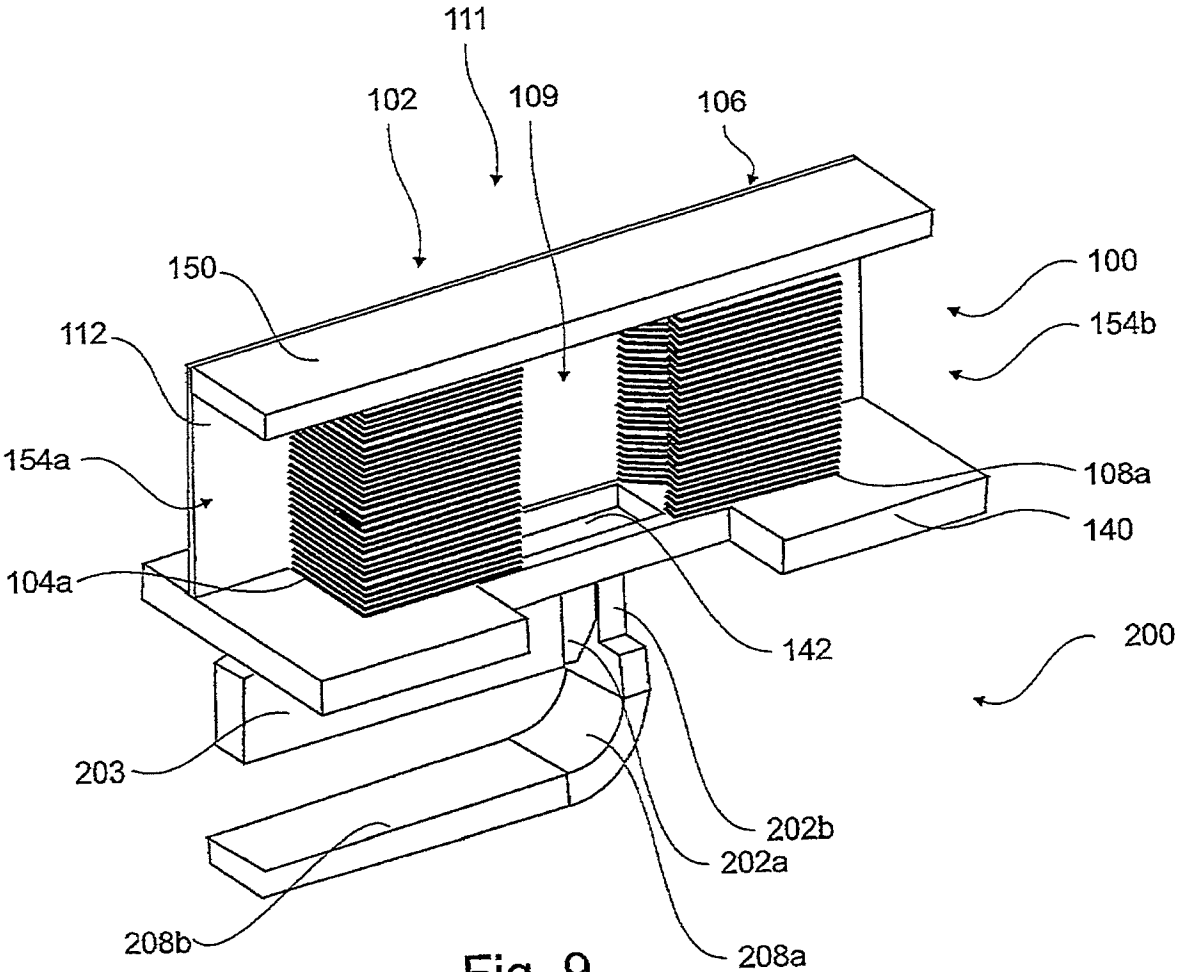
FIG. 9 shows schematically a side view of some elements of an exemplary embodiment of a circuit breaker.

The arc chute can be covered by a cover 150 shown in FIG. 9, which is fixed to the side walls 112. Hence, the number of pieces to assemble is substantially reduced.

Thus, the arc chute 100 is light and small due to the reduced clearance distance to a metallic wall of other components, for example if the circuit breaker is mounted on an electric vehicle, for example a train. Further, the metal plates of the arc chute have almost no wear. Further, there is substantially no risk of short circuits between the meal plates. Thus, it is easy to plan the maintenance of the circuit breaker, for example, of the arc chute. Further, the arc chute according to an embodiment can be quickly assembled and may be easily scalable, in particular as no plastic mould is needed. Further, the costs can be reduced.

With the arc chute according to exemplary embodiments of the present disclosure the arc does not burn always at the same place, thus the wear is more evenly distributed about the metal plates 104*a*, 104*b*, . . . 104*n*, 108*a*, 108*b*, . . . 108*n*, such that the distance of the plates may be reduced and also the thickness of the plates can be reduced.

Figure 10:
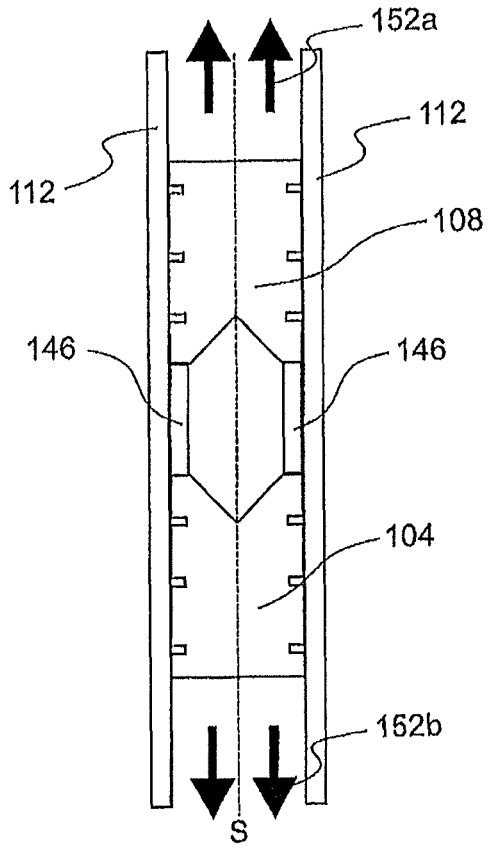
FIG. 10 shows schematically a section of an exemplary arc chute in a top view.

FIG. 10 shows a top view of a horizontal section of an embodiment of the arc chute 100. As shown in FIG. 10, the hot gases created during the disconnecting of the first switch contact and the second switch contact may substantially exhaust only in two directions 152*a*, 152*b*, for example in parallel to the direction of the moving direction S of the second switch contact. The housing of the arc chute can have openings 154*a*, 154*b* in direction of the moving direction S or an axis traversing the two stacks of the arc chute and the arc space 109. In an exemplary embodiment, the openings 154*a*, 154*b* have dimension in direction of the arc displacement direction A or stacking direction A of at least 90%, for example 95%, of the first stack 102 or the second stack of metal plates. Further, the openings 154*a*, 154*b* have a dimension orthogonal to the arc displacement direction A and the moving direction S corresponding substantially to the dimension of the metal plates, for example at least 90%, in particular at least 95% of the width of the metal plates. The width of the metal plates can be measured along a third axis orthogonal to the arc displacement direction A and orthogonal to the moving direction S.

The sidewalls 112 of the housing 111 are, for example, in contact or adjacent to the metal plates 104*a*, 104*b*, . . . 104*n* of the first stack 102 and the second stack 106. For example, the distance between the sidewalls 112 of the housing and the metal plates is less than 5 mm, such as less than 2 mm. Hence, further equipment of the rolling stock on which such a circuit breaker may be disposed may be placed close to the circuit breaker, in contrast to circuit breakers in which the gas is exhausted to all sides of the metal plates 104, 108. Thus, the gas is only exhausted in a direction parallel to the moving direction S shown with arrows 152*a* and 152*b*.

Figure 11:
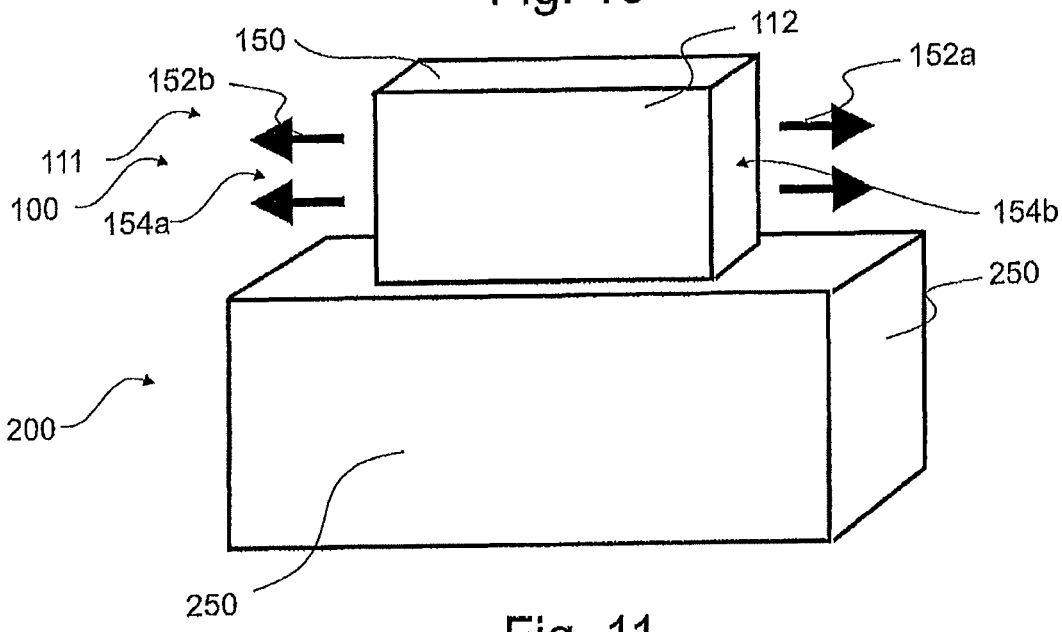
FIG. 11 shows schematically a perspective view of a circuit breaker according to an exemplary embodiment.

FIG. 11 shows a perspective view of an embodiment of a circuit breaker including the arc chute 100 and the switch unit 200. As shown in FIG. 10, the arc chute 100 is covered from the side with the sidewalls 112 and on the top with a cover plate 150.

Thus, in an exemplary embodiment, the arc chute can be easily assembled, because the sidewalls 112 and the cover plate 150 are plate shaped and fabricated of plastic. Hence, the arc chute is variable, so that he can be easily adapted to the current or the voltage to be switched, for example the number of metal plates to be inserted into the arc chute can be easily adjusted by introducing more or less groups of metal plates 128. Further, the sidewalls 112 and the top wall 150 can be easily adapted because they are just plates which can be manufactured by sawing a bigger plate to the format used by the arc chute to be produced.

In an exemplary embodiment, which may be combined with other embodiments disclosed herein, the switch unit 200 is covered by switch unit sidewalls 250, which are manufactured from plastic plates. Thus, also the switch unit 200 may be easily manufactured.

For example, for high voltage DC breakers the total arcing time is much longer than for AC. Thus, higher temperatures are created and plasma may be generated between the first switch contact and the second switch contact and in the arc chute.

The written description uses examples to disclose the disclosure, including the best mode, and also to enable any person skilled in the art to make and use the disclosure. While the disclosure has been described in terms of various specific embodiments, those skilled in the art will recognize that the disclosure can be practiced with modifications within the spirit and scope of the claims. Especially, mutually nonexclusive features of the embodiments described above may be combined with each other. The patentable scope of the disclosure is defined by the claims, and may include other examples that occur to those skilled in the art. Such other examples are to be within the scope of the claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Arc chute for a traction vehicle DC circuit breaker or for a substation DC circuit breaker working at medium voltages between 600V and 3600V, the arc chute comprising:

at least two stacks of a plurality of substantially parallel metal plates, at least one of the two stacks defining a first axis in parallel to a stacking direction;

an arc space adapted for extending an arc along the first axis substantially orthogonal to the first axis;

a second axis traversing in parallel to the at least two stacks and the arc space;

an arc-chute housing having at least one side wall, the at least one side wall being substantially parallel to the second axis; and the housing of the arc chute having openings in a direction of the second axis for exhausting gas, wherein a distance between the at least one sidewall and the metal plates is less than 5 mm.

2. Arc chute according to claim 1, comprising:

a plurality of substantially parallel deflectors for guiding gas out of the arc chute.

3. Arc chute according to claim 1, wherein the metal plates are substantially rectangular and have a substantially V-shaped cut-out directed to the arc space, wherein the second axis is substantially parallel to two side edges of the metal plates adjacent to the sidewalls.

4. Arc chute according to claim 2, wherein the parallel deflectors are inserted in respective grooves in the at least one sidewall.

5. Arc chute according to claim 1, wherein more than 70% of a surface of a metal plate of the at least one stack faces a surface of an adjacent metal plate in a same stack.

6. Arc chute according to claim 1, wherein the metal plates of the arc chute having a surface of about 3000 $mm^2$ to about 12000 $mm^2$ and/or have a ratio between extension in a longitudinal direction, parallel to the second axis, and an extension in a transversal direction of about 1 to 2.

7. Arc chute according to claim 1, wherein the at least one stack comprises:

a group of metal plates, wherein the metal plates of the group of metal plates are supported by at least one support device adapted to maintain the metal plates in a parallel relationship to another and adapted to insert and remove the group of metal plates together.

8. Arc chute according to claim 1, wherein each metal plate of the group of metal plates comprises:

a plurality of cut-outs for inserting the support device, wherein the metal plates and the support device are adapted to each other, such that when metal plates of the group of metal plates are arranged on the support device, a rearward edge of the support device opposite to the metal plate lies substantially at a same or a greater distance to the sidewall than the metal plate, with the side edge parallel to the second axis of the metal plate, into which the support device is inserted.

9. Arc chute according to claim 1, wherein the metal plates of the group of metal plates have respectively a distance between each other of about 2 mm to about 4 mm.

10. The arc chute according to claim 1, in combination with a traction vehicle DC circuit breaker or substation DC circuit breaker, comprising:

a switch unit having a first switch contact and a second switch contact, wherein the second switch contact is movable between a first position, wherein the first switch contact contacts the second switch contact, and a second position in which the first and second switch contacts are separated from each other.

11. Arc chute according to claim 10, wherein the second switch contact is movable substantially along a moving direction which is orthogonal to the stacking direction.

12. Arc chute according to claim 10, wherein currents with more than 600 Ampere can be switched.

13. Arc chute according to claim 10, comprising:

at least one gas emitting element including a gas emitting layer having a layer surface facing the first switch contact and the second switch contact.

14. Arc chute according to claim 10, wherein the circuit breaker is an air circuit breaker.

15. Arc chute according to claim 10, wherein the traction vehicle DC circuit breaker is a circuit breaker for a railway vehicle.

16. Arc chute according to claim 10, wherein the second switch contact is movable substantially along a moving direction, wherein the second axis is substantially parallel to the moving direction.

17. Method for assembling an arc chute of a traction vehicle DC circuit breaker or substation DC circuit breaker working at medium voltages between 600V and 3600V, the method comprising:

stacking a plurality of substantially parallel metal plates parallel to a first axis, wherein the arc space is adapted to allow an arc to extend along the first axis and wherein a second axis traverses in parallel to the metal plates and the arc space, substantially orthogonal to the first axis;

mounting at least one side wall of a housing of the arc chute substantially parallel to the second axis, wherein a distance between sidewalls and the metal plates is less than 5 mm; and inserting a plurality of substantially parallel deflectors in respective grooves in at least one sidewall.

18. Method according to claim 17, comprising:

mounting the arc chute on a switching unit.

19. Arc chute according to claim 1, wherein the distance is less than 2 mm.

20. Arc chute according to claim 1, wherein more than 90% of a surface of a metal plate of the at least one stack faces a surface of an adjacent metal plate in a same stack.

21. Arc chute according to claim 1, wherein the metal plates of the arc chute having a surface of about 5000 $mm^2$ and about 8000 $mm^2$ and/or have a ratio between extension in a longitudinal direction, parallel to the second axis, and an extension in a transversal direction of about 1.1 to 1.5.

22. Arc chute according to claim 1, wherein the metal plates of the group of metal plates have respectively a distance between each other of about 2.5 mm.

* * * * *